US010445974B2

(12) United States Patent
Watkins

(10) Patent No.: US 10,445,974 B2
(45) Date of Patent: Oct. 15, 2019

(54) GAMING MACHINE AND METHOD HAVING BONUS FEATURES FOR MULTIPLE GAME PRESENTATIONS

(71) Applicant: Everi Games, Inc., Austin, TX (US)

(72) Inventor: Brian Watkins, Austin, TX (US)

(73) Assignee: Everi Games, Inc., Austin, TX (US)

( * ) Notice: Subject to any disclaimer, the term of this patent is extended or adjusted under 35 U.S.C. 154(b) by 49 days.

(21) Appl. No.: 15/872,814

(22) Filed: Jan. 16, 2018

(65) Prior Publication Data

US 2019/0102972 A1 Apr. 4, 2019

Related U.S. Application Data

(60) Provisional application No. 62/566,392, filed on Sep. 30, 2017.

(51) Int. Cl.
*G07F 17/32* (2006.01)

(52) U.S. Cl.
CPC ..... *G07F 17/3211* (2013.01); *G07F 17/3209* (2013.01); *G07F 17/3227* (2013.01); *G07F 17/3288* (2013.01)

(58) Field of Classification Search
USPC ..... 463/20
See application file for complete search history.

(56) References Cited

U.S. PATENT DOCUMENTS

2011/0230248 A1* 9/2011 Baerlocher ..... G07F 17/32 463/16
2011/0263308 A1* 10/2011 Evans ..... G07F 17/3293 463/13
2013/0079123 A1* 3/2013 Nicely ..... G07F 17/3225 463/26
2013/0244763 A1* 9/2013 Baerlocher ..... G07F 17/32 463/25
2017/0084130 A1* 3/2017 Nicely ..... G07F 17/3239
2017/0148250 A1* 5/2017 Angermayer ..... G06T 17/20

* cited by examiner

*Primary Examiner* — Pierre E Elisca
(74) *Attorney, Agent, or Firm* — Nathan H. Calvert; The Culbertson Group, P.C.

(57) ABSTRACT

A gaming machine and method for providing multiple simultaneous virtual game presentations to a player. The machine controller is programmed to operate the virtual game presentations in response to player wagers, and determine if virtual game presentations all include a winning pattern. If so, the controller activates a bonus game structure to display the conduct of a bonus game and a bonus game result. A trigger pattern may replicate to selected virtual game presentations. The bonus game operates to select a multiplier value applied to all of the results from the multiple virtual game presentations.

13 Claims, 11 Drawing Sheets

GAMING MACHINE AND METHOD HAVING BONUS FEATURES FOR MULTIPLE GAME PRESENTATIONS

CROSS-REFERENCE TO RELATED APPLICATIONS

This application claims the benefit of U.S. Provisional Application No. 62/566,392, filed Sep. 30, 2017, titled "Gaming Machine And Method Having Bonus Features For Multiple Game Presentations" which application is hereby incorporated by reference for all purposes.

FIELD OF THE INVENTION

This invention relates to gaming systems and to gaming machines through which players may participate in wagering games, and in particular slot machine games with a feature game that provides accumulating persistent events.

BACKGROUND

Many different types of gaming machines have been developed to provide various formats and graphic presentations for conducting games and presenting game results. For example, numerous mechanical reel-type gaming machines, also known as slot machines, have been developed with different reel configurations, reel symbols, and paylines. More recently, gaming machines have been developed with video monitors that are used to produce simulations of mechanical spinning reels. These video-based gaming machines may use one or more video monitors to provide a wide variety of graphic effects in addition to simulated spinning reels, and may also provide secondary/bonus games using different reel arrangements or entirely different graphics. Many video-based gaming machines have three or five spinning reels that may be stopped to display a matrix of game symbols. The symbols displayed on the stopped reels correlate to a result of the game. Video-based gaming machines may also be used to show card games or various types of competitions such as simulated horse races in which wagers may be placed.

Game manufacturers are continuously pressed to develop new game presentations, formats, and game graphics in an attempt to provide high entertainment value for players and thereby attract and keep players. What is needed are ways to provide both anticipation and excitement to players while providing more variability in game results.

SUMMARY OF THE INVENTION

The present invention includes wagering games, gaming machines, networked gaming systems that provide improvements to feature games played on slot machines or other gaming machines. A gaming machine and method for providing multiple simultaneous virtual game presentations to a player. The machine controller is programmed to operate data structures corresponding to four or more virtual game presentations. The virtual game presentations are activated in response to player wagers, and the controller determines if virtual game presentations all include a winning pattern. If so, the controller activates a bonus game structure to display the conduct of a bonus game and a bonus game result. The bonus game operates to select a multiplier value applied to all of the results from the multiple virtual game presentations.

In some embodiments, detection of certain trigger patterns before the virtual game presentations are evaluated for wins may cause the processor or gaming method to select other virtual game presentations based on a characteristic of the presentation having the trigger pattern. The other presentations are then modified before evaluating them for winning patterns.

According to another aspect of the invention, a method of providing wagering game operated on a gaming machine employing the data structures and controller process, and awarding resulting prizes.

Another aspect of the invention is a computer program stored on a non-transitory readable medium. The software version is, of course, typically designed to be executed by a gaming machine or networked gaming system. The software includes multiple portions of computer executable code referred to as program code. Gaming results are provided in response to a wager and displayed by display program code that generates simulated slot reels each including one or more symbol locations. The program also has game controller program code for determining game play results involving spins or other randomization of the multiple virtual game presentations and the bonus game structure.

Another aspect of the invention is a gaming system that includes one or more gaming servers, and a group of electronic gaming machines connected to the servers by a network, programmed to provide one of more of the methods described herein. The various functionality described herein may be distributed between the electronic gaming machines and the gaming servers in any practically functional way. For example, the current preferred architecture is for the servers to determine all aspects of game logic, random number generation, and prize awards. The gaming machines provide functionality of interfacing with the player and animating the game results to present the results received from the server in an entertaining manner. However, other embodiments of course might use a thin client architecture in which the animation is also conducted by the server and electronic gaming machines serve merely as a terminal to receive button or touchscreen input from the player and to display graphics received from the server.

Different features may be included in different versions of the invention. These and other advantages and features of the invention will be apparent from the following description of the preferred embodiments, considered along with the accompanying drawings.

DETAILED DESCRIPTION OF EXAMPLE EMBODIMENTS

Figure 1:
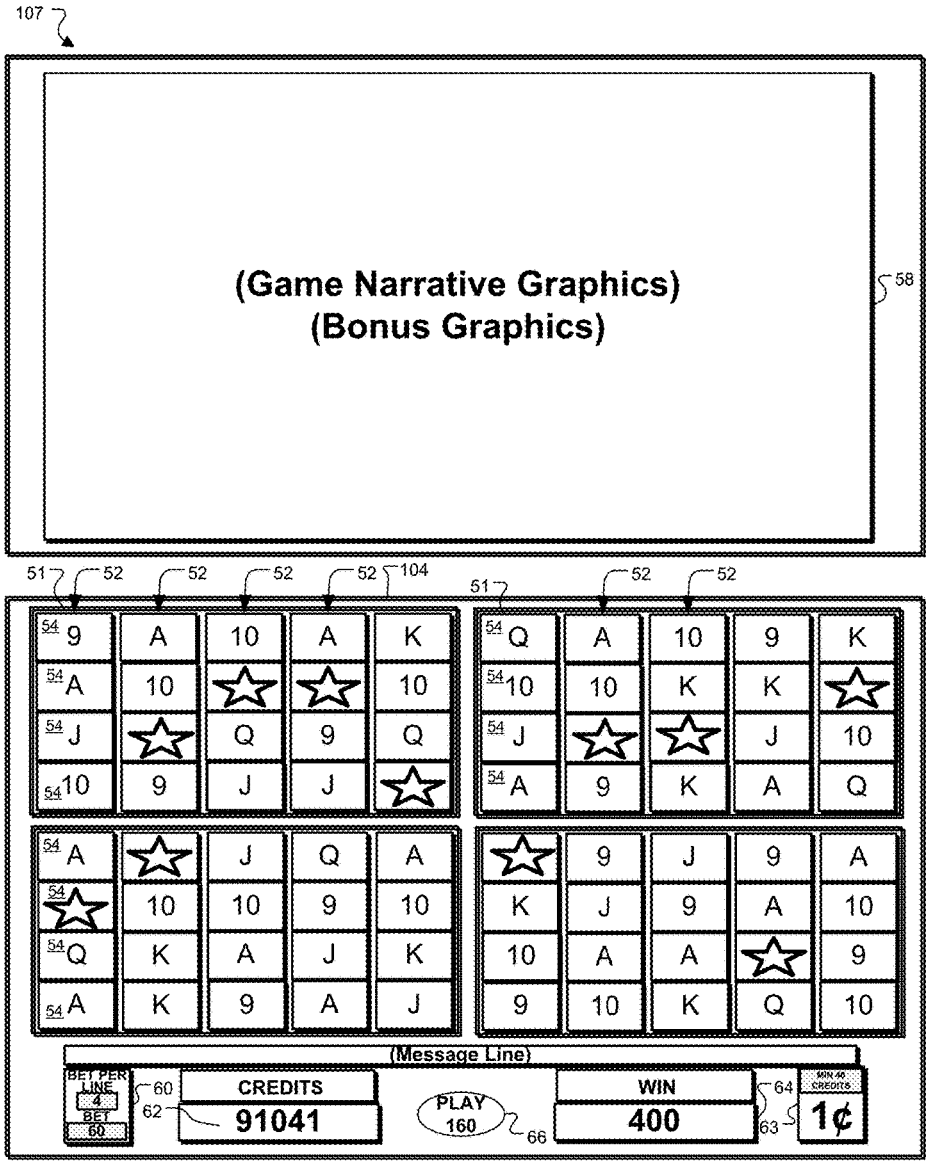
FIG. 1 is a game screen diagram showing a base game mode having multiple game presentations according to an example embodiment.
Figure 7:
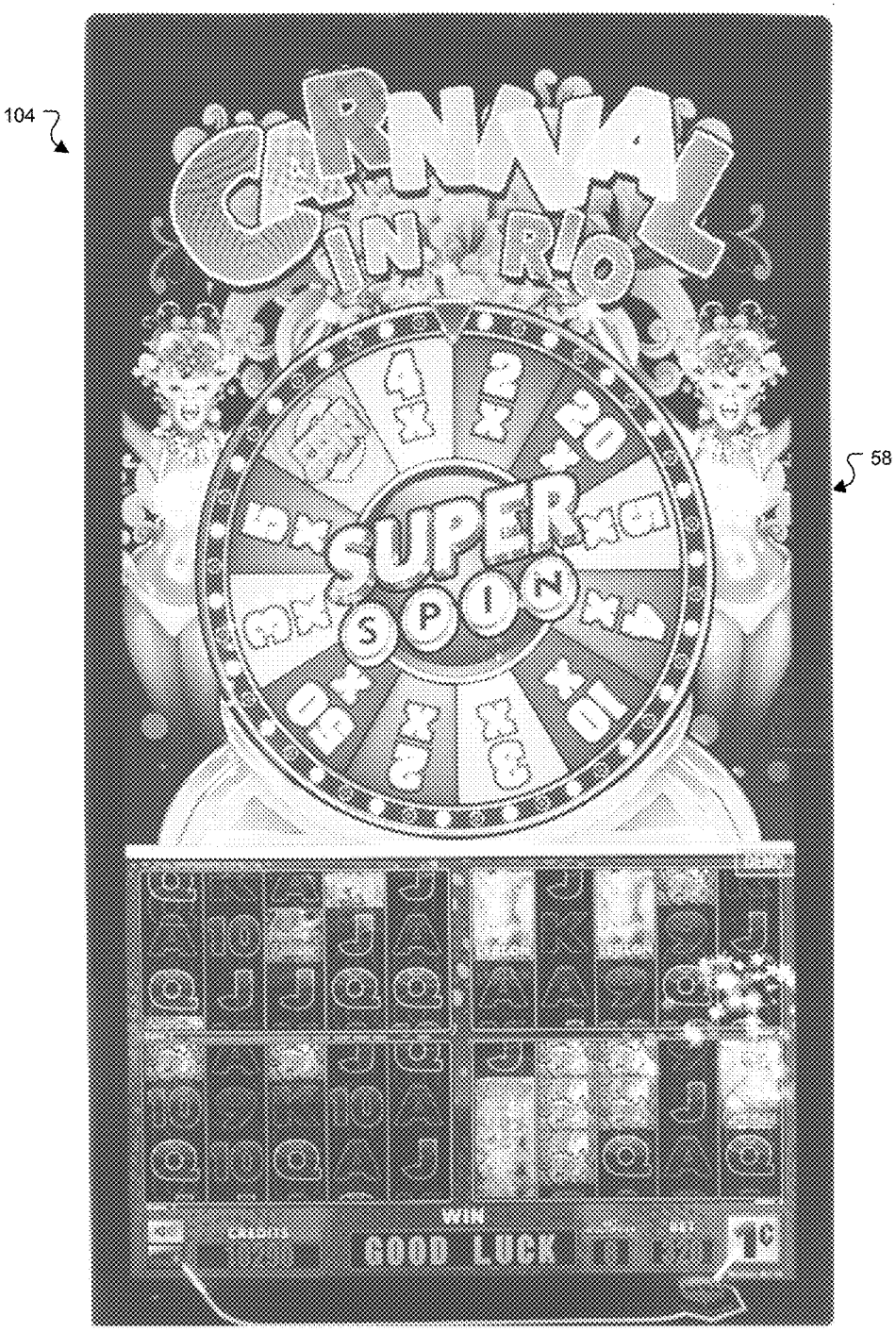
FIGS. 7-11 are a sequence of screenshots showing the progression of a game play with a bonus spin according to an example embodiment.

FIG. 1 is a game screen diagram illustrating a base game mode showing the primary display 104 and secondary (top) display 107 to illustrate an example slot machine display arrangement on which wagering game results are presented in a gaming area, typically found on the primary display. On the secondary display 107 display area 58 shows game narrative graphics 58 which may be animated during or between games as part of the multimedia theme of the game. Display area 58 may also show bonus graphics such as the bonus wheel element shown in the example of FIG. 7. The screenshot of FIG. 7 shows graphics of a game in which a single large primary display 104 is used containing both of the display areas that are shown on separate display in FIG. 1. The description herein applies to either configuration or any other suitable display configuration.

Referring to FIG. 1, the gaming area of display 104 includes four separate presentations of different reel-type base games (as opposed to bonus games or other feature games as described herein), each presentation including a matrix 51 of symbol locations arranged in rows and columns to represent simulated slot machine reels that are spun to conduct a game round. Other embodiments may, of course, use other types of game displays to display randomizing of symbols according to the methods herein. The depicted columns of symbols labeled 52 represent the simulated reels, while symbols are shown in each symbol location designated 54. In this embodiment, each of the four game presentations includes five reels with four symbol locations 54 displayed at a time on each reel, but the game can be played with more and less reels. Each simulated reel typically has far more symbols than those displayed, and as many unique stop positions as there are symbols on the simulated reel. The stop position may be counted, for example, by numbering the symbols on the simulated reel and using the number of the symbol at the bottom of the display window (the three symbols displayed in this example), or at the top or middle. Further, while multi-symbol reels are shown, other versions may use simulated uni-symbol reels, or a reel that has many symbols thereon but only a single window to the reel simulated, displaying a single symbol from the reel. Some variations of the present invention may use a simulated uni-symbol reel in each depicted symbol location 54, while still conducting and evaluating the individual game presentations as 5×4 arrays of symbol locations. Winning patterns are typically formed by matching symbols along defined paylines within each 51. As such, each game presentation matrix 51 presents an opportunity separate from the others to win prizes based on paylines and other winning events such as bonus triggers appearing in the four game presentations.

Figure 9:
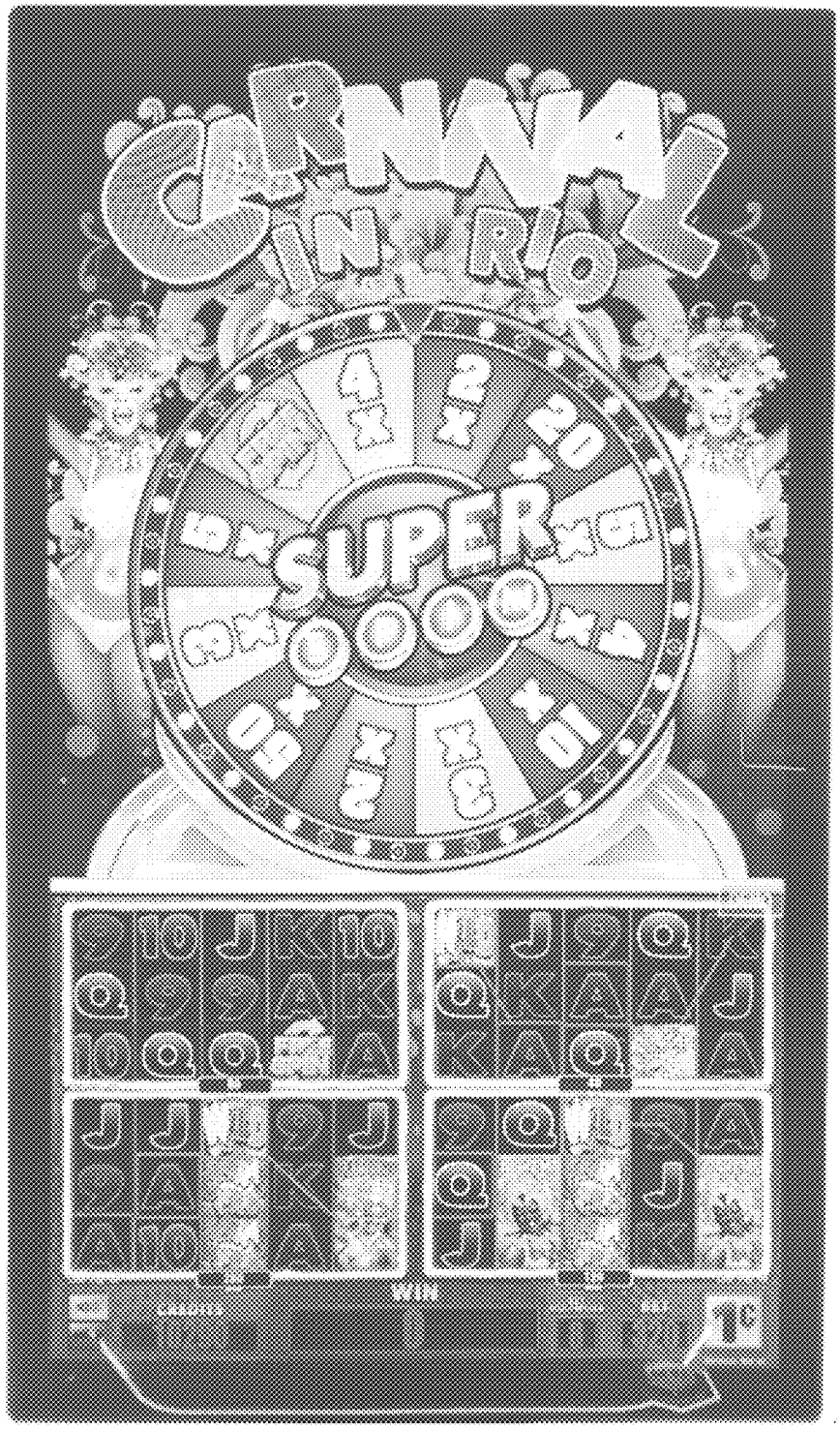

Below the gaming area is several indicators showing the current wagering settings and credit information. On the left is box 60, which displays the current wager and amount bet per payline. Some versions may not have a designated bet per line since very many paylines may be used in the four separate game presentations. To the right of box 60 is box 62, which displays the current credits in the player's account. In the bottom center a touchscreen play button 66 is presented in the lower central area of the display, which may show other game state related graphics. Right of this is win box 64, which displays the player's last awarded winnings. In some versions, each matrix 51 may have an individual win box that appears along the bottom of the matrix if a winning pattern is found in that matrix. For example, the screenshot of FIG. 9 shows a result in which all four of the sub-games produced winning patterns in their respective symbol matrices, and centered on the lower edge of each matrix a dark box appears to show the individual win amount for that matrix. In FIG. 1, the wager credit denomination is shown in box 63. Along the bottom edge of the matrices 51 there is a message line, where the game station can display further instructions to the player.

Figure 2:
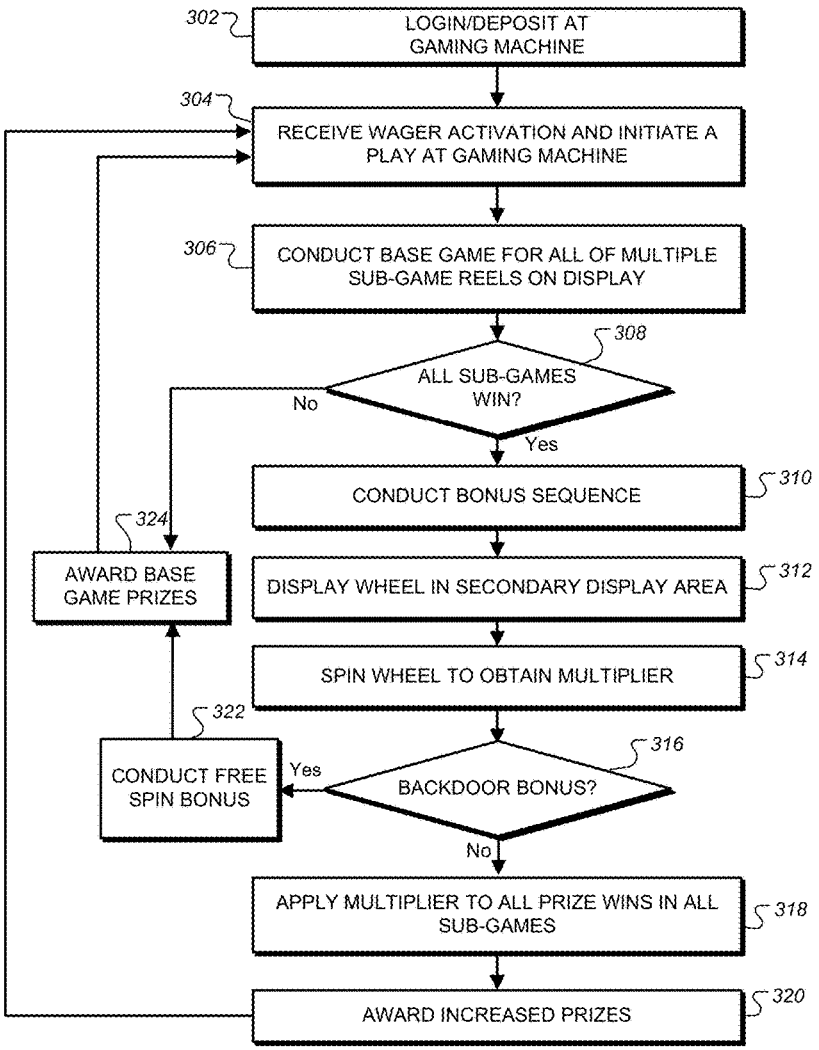
FIG. 2 is a block diagram of a process for providing a wagering game according to an example embodiment.

FIG. 2 is a flowchart showing a process for providing a wagering game according to one or more embodiments of the invention. Generally, the process is conducted under control of one or more electronic processors to present gaming results on one or more displays on a gaming machine such as those described below. The process starts at block 302 where a player logs in or deposits money or a credit voucher at a gaming machine. To begin a game play, the method receives a wager activation on a player input device at the gaming machine at block 304, which typically consists of some input from the player to set the amount to be wagered from their credit amount on the machine. Preferably a single wager applies to all four of the game presentations and there is no ability to wager on a particular presentation separately. The wager amount may also be carried over from previous game rounds by simply starting the game with the previous wager amount set. In some versions, a single wager enters without dividing it between the various game presentations (sub-games) displayed, with a single mathematical game engine 204 (FIG. 4) controlling all four game presentations. In other versions, each game presentation is controlled by a separate game engine 204, and a portion of the player's base game wager is allocated to each of the sub-games.

The game is started through a 'Play' button (110, FIG. 3) on the game cabinet or touchscreen display, and serves to place the wager and start a single round of game play in the base game at block 306. In embodiments having reels, reel displays, or simulated reels, game play is conducted by spinning the reels. Other embodiments may otherwise rearrange or randomize the symbols on the matrix in any suitable manner. For games that use other methods of scrambling the matrix besides simulated reels, the random outcome is determined at this step as appropriate for the game. The preferred version generates at least one random number and uses the at least one random number to determine a set of game reel stops, which is fed to a first data structure (230, FIG. 4) for providing the multiple game presentations. Separate reel stops are provided for each game presentation and specify a position in which multiple simulated or mechanical reels in of the game presentations will stop to display symbols in a symbol array in a spin outcome for the wager. Preferably the multiple game presentations are activated simultaneously, by activating multiple game presentation data structures 230, with the presentations having some period during their game presentation in which all the presentations show motion, reel spinning, or other randomization of the symbols simultaneously. In the example sequence of screenshots found in FIGS. 7-11, the reel spinning state can be seen in FIG. 7 in which all four depicted matrices have spinning reels. The sub-game presentations also stop to produce a result simultaneously, or may stop sequentially to heighten anticipation of winning results.

A base game round is conducted concluding with base game results in which the multiple matrices of symbol locations displayed are populated with randomly selected symbols. Each of the matrices may be considered a separate game presentation and result, but they are referred to as sub-games because preferably the multiple outcomes are all based on the single wager and a single random outcome from a random number or a randomized pre-generated outcome provided by a random number generator or bank of outcomes on the gaming machine or on a central determinant server (405, FIG. 5). The base game results include a possibility of winning money value credits and a possibility of winning a bonus game outcome.

Next at block 308, the process determines if the four or more virtual game presentations all include a winning pattern, and if so, at block 310 it activates the bonus game structure 232 (FIG. 4) to display the conduct of a bonus game and a bonus game result. The bonus game may have many suitable forms, but in this embodiment it includes a spinning sectional wheel that is described by the second data structure, the bonus game data structure, which is activated to display an instantiation of the wheel in on one of the gaming machine displays at block 312. Preferably the bonus game is displayed on the secondary display 107, or a secondary display area 58 which may presented on a large single display such as the example screenshot of FIG. 9. An example game state at this point in the process, after a win is found on all of the sub-game presentations, is shown in FIG. 9.

Figure 10:
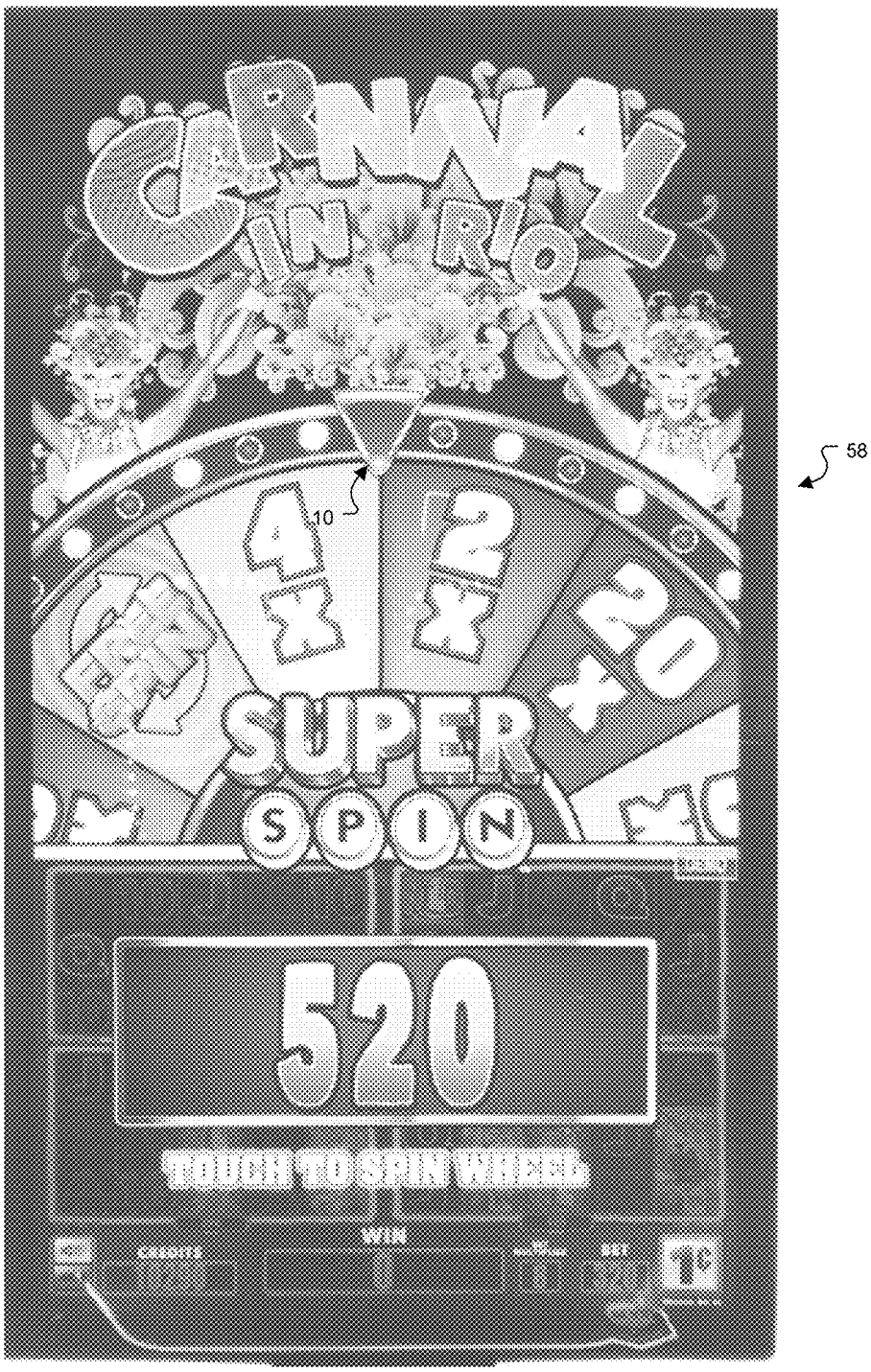
Figure 11:
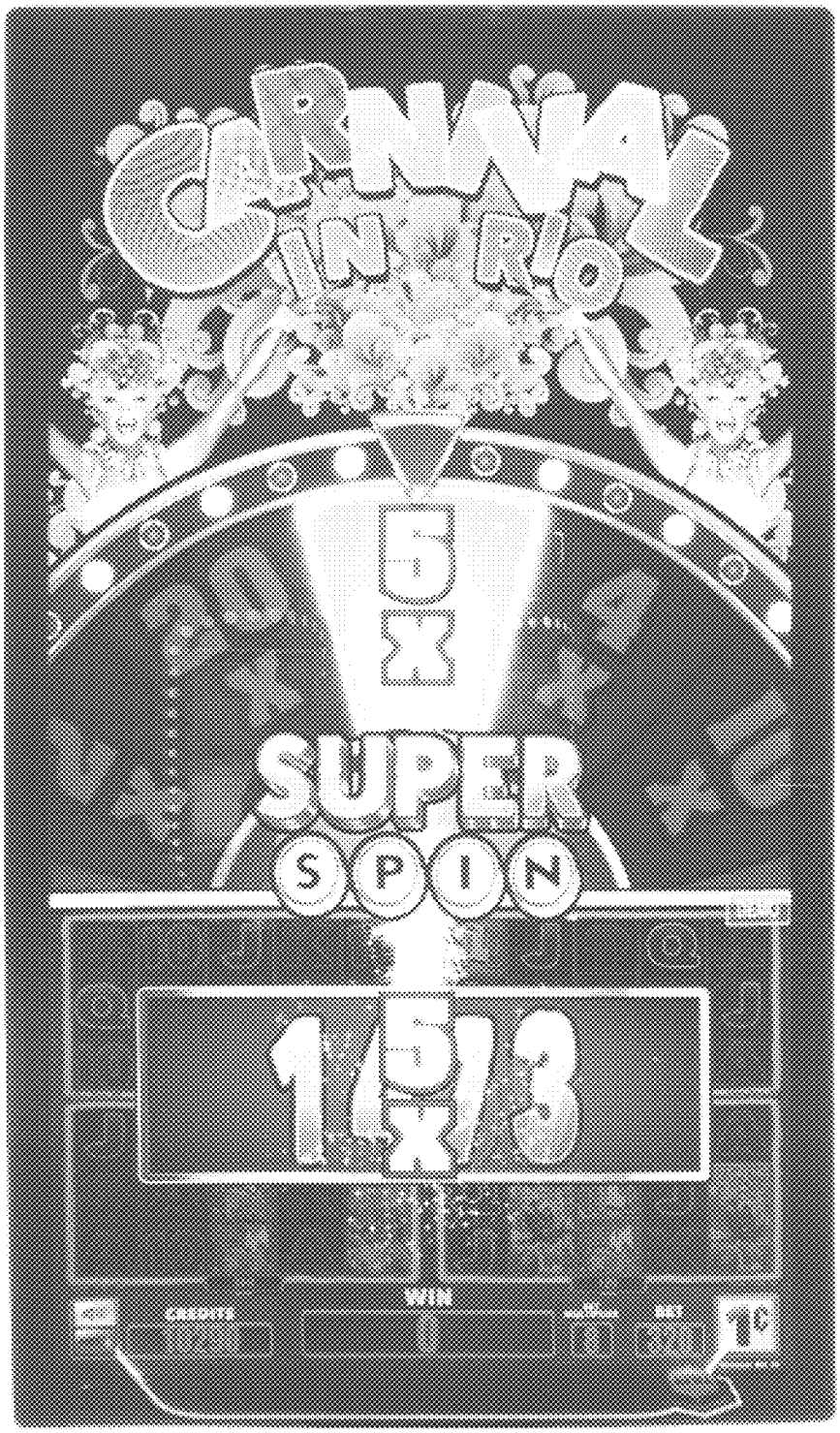

To conduct the bonus game, the process at block 314 performs a spin of the wheel, with a marker highlighting or identifying a segment of the wheel as is known in wheel spin type games. Preferably, the second data structure 232 representing the bonus game structure includes a wheel with a plurality of sections containing different multiplier values and other bonus outcomes. The wheel is adapted to be spun when activated and stop on a section to select the multiplier value of that section at block 314. The displayed wheel may also include a section operable to activate a free spin bonus when the wheel stops on that section. An example of the game presentation in this state is shown in the screenshot of FIG. 10, where the player is prompted to touch to spin the wheel. As shown, the bonus game presentation in display area 58 may change to enlarge the wheel displayed to focus on only a section, showing fewer wheel segments and enlarging the selector element 10 which identifies the spin outcome by pointing to the segment selected by the spin. The process checks for the free spin segment being selected at block 316, and if this segment is selected proceeds to block 322 to conduct the free spin bonus. If a multiplier value was selected in the spin, the process goes to block 318 where it applies the selected multiplier to all of the credits awards of the four or more game presentations and then award the resulting amount to the credit balance at block 320. The screenshot of FIG. 11 shows an example bonus game outcome in which a 5× multiplier is selected and the base game prize win is in process of being increased by 5×. If no bonus condition exists back at block 318, or if a free spin bonus is completed, the process goes to block 324 where any base game prizes from the original results of the multiple game presentations are awarded. Then the process continues to return to block 304 for more wager activations, until it receives a player cash-out input through the player controls and, in response, initiate a payout of the credit balance.

The process functionality is controlled by the system processor by executing program code, executable by a gaming machine or gaming network processor, to accomplish the functionality as described herein. It should be understood that this is only one example embodiment, and other versions may divide the processing tasks of the game method in a different manner. For example, some systems may employ a thin client architecture in which practically all of the processing tasks are performed at the game server, and only display information for the player interface transmitted to the electronic gaming machine. In such an embodiment, only the steps involving player input or display are performed by the electronic gaming machine, with the remaining steps performed by one of the game servers in the system. In such a case, though, the software architecture is preferably designed as a thin client in which a dedicated virtual machine running on the game server (or a virtual machine server connected in the gaming network) performs the tasks designated in the present drawing as occurring "at the gaming machine." In the depicted flowcharts, the method is performed by the respective computer hardware operating under control of computer program code. While central processor arrangements may vary (for example award controllers may be integrated on the same machine with a gaming server, or may be a separate server connected on a secure network), the particular central determinant architecture is not limiting and will be referred to generally in this drawing as the game server (403). To complete the base game and bonus game at blocks 306 and 310 of FIG. 2, the thin client version of the process, performed at the game server, further includes receiving game play requests originating from electronic gaming machine 100, and sending commands to the gaming machine to show reels spinning, the feature game selection process, the wheel enhancement feature game, and results being displayed. The division of game logic steps between gaming machines and servers is known in the art and may be accomplished according to suitable methods allowed for the relevant gaming jurisdictions.

Figure 3:
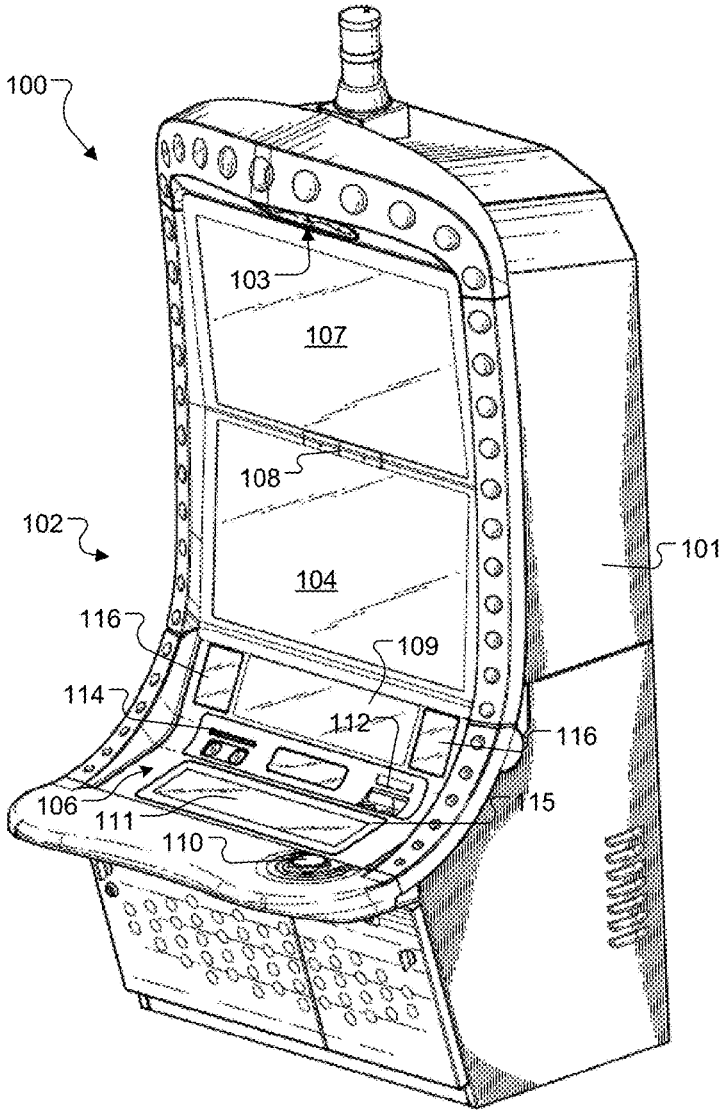
FIG. 3 is a front perspective view of a gaming machine which may be used in a gaming system of the present invention.
Figure 4:
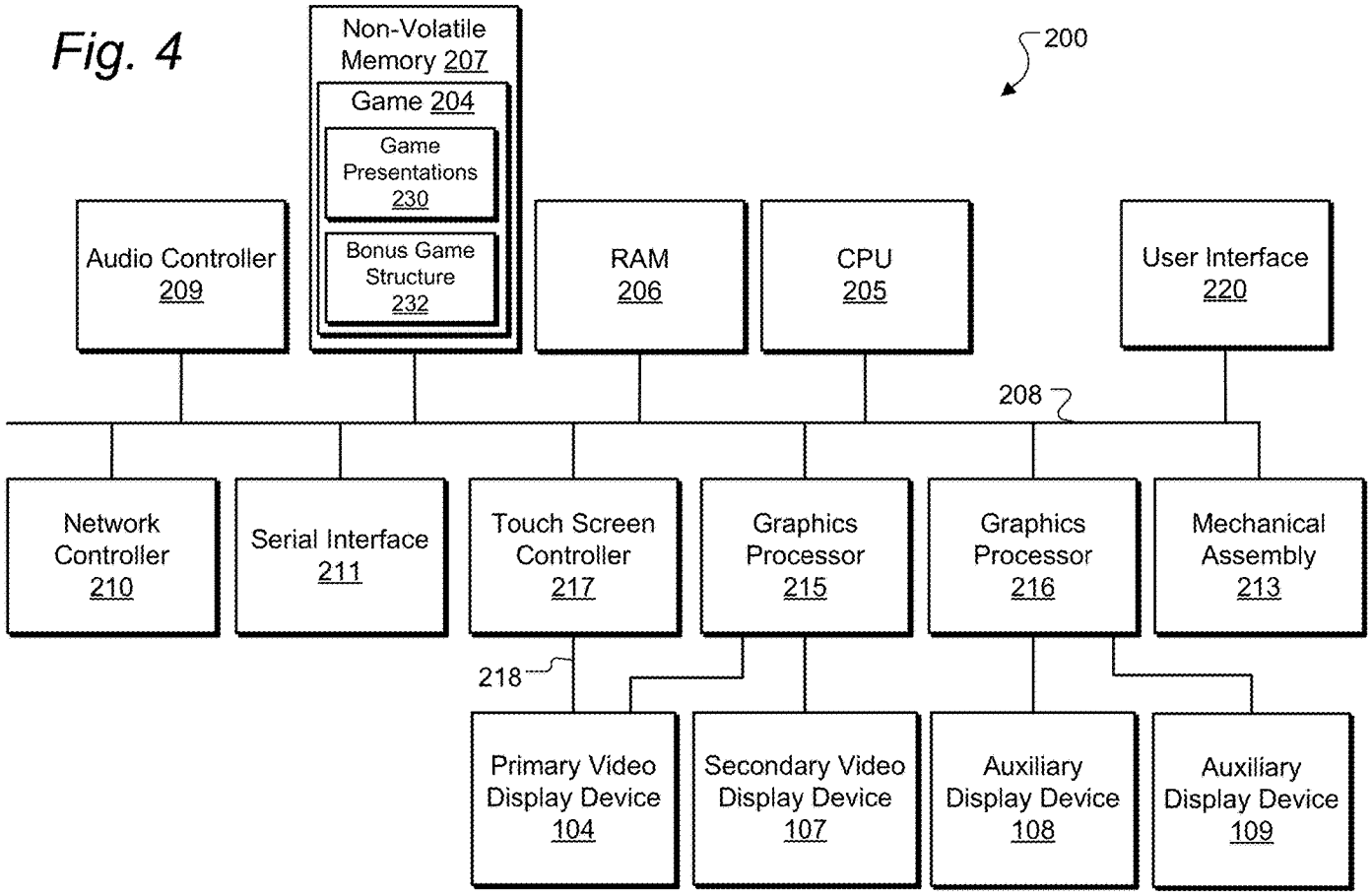
FIG. 4 is a block diagram showing various electronic components of the gaming machine shown in FIG. 3 together with additional gaming system components.

FIG. 3 shows a gaming machine 100 that may be used to implement feature games according to the present invention. The block diagram of FIG. 4 shows further details of gaming machine 100. Referring to FIG. 3, gaming machine 100 includes a cabinet 101 having a front side generally shown at reference numeral 102. A primary video display device 104 is mounted in a central portion of the front surface 102, with a ledge 106 positioned below the primary video display device and projecting forwardly from the plane of the primary video display device. In addition to primary video display device 104, the illustrated gaming machine 100 includes a secondary video display device 107 positioned above the primary video display device. Gaming machine 100 also includes two additional smaller auxiliary display devices, an upper auxiliary display device 108 and a lower auxiliary display device 109. All of the displays may include touchscreen sensors, especially display 109 which may be used to present touchscreen controls for wagering. It should also be noted that each display device referenced herein may include any suitable display device including a cathode ray tube, liquid crystal display, plasma display, LED display, or any other type of display device currently known or that may be developed in the future.

In preferred versions, the gaming machine 100 illustrated in FIG. 3 also includes a number of mechanical control buttons 110 mounted on ledge 106. These control buttons 110 may allow a player to select a bet level, select paylines, select a type of game or game feature, and actually start a play in a primary game. Further, primary video display device 104 in gaming machine 100 provides a convenient display device for implementing touchscreen controls.

Gaming machine 100 may also include a number of other player interface devices in addition to devices that are considered player controls for use in playing a particular game. The ledge may also include a hardware special object including a button, touch sensor, or switches, joysticks, or other mechanical input devices, and/or virtual buttons and other controls implemented on a suitable touchscreen video display. Gaming machine 100 also includes a currency/voucher acceptor having an input ramp 112, a player card reader having a player card input 114, and a voucher/receipt printer having a voucher/receipt output 115. One or more of these devices provides a credit input device in communication with the controller and adapted for accepting a physical item associated with a monetary value that establishes a player credit balance. Audio speakers 116 generate an audio output to enhance the user's playing experience.

FIG. 4 shows a logical and hardware block diagram 200 of gaming machine 100 which includes a central processing unit (CPU) 205 along with random access memory 206 and nonvolatile memory or storage device 207. Storage device 207 is a tangible, nontransitory (nonvolatile) memory holding the program code 204 for presenting the game results as described herein, including a first data structure 230 for implementing the multiple game presentations and a second data structure 232 for implementing the bonus game. All of these devices are connected on a system bus 208 with an audio controller 209, a network controller 210, and a serial interface 211. A graphics processor 215 is also connected on bus 208 and is connected to drive primary video display device 104 and secondary video display device 107 (both mounted on cabinet 101 as shown in FIG. 3). A second graphics processor 216 is also connected on bus 208 in this example to drive the auxiliary display devices 108 and 109 also shown in FIG. 3. As shown in FIG. 4, gaming machine 100 also includes a touch screen controller 217 connected to system bus 208. Touch screen controller 217 is also connected via signal path 218 to receive signals from a touchscreen element associated with primary video display device 104. Secondary display device 109 may also include an integrated touchscreen controller. It will be appreciated that the touchscreen element itself typically comprises a thin film that is secured over the display surface of primary video display device 104. The touchscreen element itself is not illustrated or referenced separately in the figures.

Those familiar with data processing devices and systems will appreciate that other basic electronic components will be included in gaming machine 100 such as a power supply, cooling systems for the various system components, audio amplifiers, and other devices that are common in gaming machines. These additional devices are omitted from the drawings so as not to obscure the present invention in unnecessary detail.

All of the elements 205, 206, 207, 208, 209, 210, and 211 shown in FIG. 4 are elements commonly associated with a computer system architecture. These elements are preferably mounted on a chassis and is itself mounted in cabinet 101 shown in FIG. 3. Alternatively, the various electronic components may be mounted on one or more circuit boards housed within cabinet 101 without a separate enclosure such as those found in personal computers. Those familiar with data processing systems and the various data processing elements shown in FIG. 4 will appreciate that many variations on this illustrated structure may be used within the scope of the present invention. For example, since serial communications are commonly employed to communicate with a touch screen controller such as touch screen controller 217, the touch screen controller may not be connected on system bus 208, but instead include a serial communications line to serial interface 211, which may be a USB controller or a IEEE 1394 controller for example. It will also be appreciated that some of the devices shown in FIG. 4 as being connected directly on system bus 208 may in fact communicate with the other system components through a suitable expansion bus. Audio controller 209, for example, may be connected to the system via a PCI bus. System bus 208 is shown in FIG. 4 merely to indicate that the various components are connected in some fashion for communication with CPU 205 and is not intended to limit the invention to any particular bus architecture. Numerous other variations in the gaming machine internal structure and system may be used without departing from the principles of the present invention.

It will also be appreciated that graphics processors are also commonly a part of modern computer systems. Although separate graphics processor 215 is shown for controlling primary video display device 104 and secondary video display device 107, and graphics processor 216 is shown for controlling both auxiliary display devices 108 and 109, it will be appreciated that CPU 205 may control all of the display devices directly without any intermediate graphics processor. In some embodiments, the persistent event meter 1506 may be displayed on secondary video display 107 rather than beside the matrix of symbol locations or other type of primary gaming zone on the primary display. The invention is not limited to any particular arrangement of processing devices for controlling the video display device included with gaming machine 100. Also, a gaming machine implementing the present invention is not limited to any particular number of video display devices or other types of display devices.

In the illustrated gaming machine 100, CPU 205 executes software which ultimately controls the entire gaming machine including the receipt of player inputs and the presentation of the graphic symbols displayed according to the invention through the display devices 104, 107, 108, and 109 associated with the gaming machine. As will be discussed further below, CPU 205 either alone or in combination with graphics processor 215 may implement a presentation controller for performing functions associated with a primary game and bonus game that may be available through the gaming machine. CPU 205 also executes software related to communications handled through network controller 210, and software related to various peripheral devices such as those connected to the system through audio controller 209, serial interface 211, and touch screen controller 217. CPU 205 may also execute software to perform accounting functions associated with game play. Random access memory 206 provides memory for use by CPU 205 in executing its various software programs, while the nonvolatile memory or storage device 207 may comprise a hard drive, flash drive, or other mass storage device providing storage for programs not in use or for other data generated or used in the course of gaming machine operation. Network controller 210 provides an interface to other components of a gaming system in which gaming machine 100 is included. In particular, network controller 210 provides an interface to a game controller which controls certain aspects of the persistent game mode as will be discussed below in connection with FIG. 4A.

It should be noted that the invention is not limited to gaming machines employing the computer-type arrangement of processing devices and interfaces shown in example gaming machine 100. Other gaming machines through which the features herein are implemented may include one or more special purpose processing devices to perform the various processing steps for implementing the present invention, such as generating random numbers or checking the security status of software packages or gaming credit vouchers. Unlike general purpose processing devices such as CPU 205, these special purpose processing devices may not employ operational program code to direct the various processing steps.

It should also be noted that the invention is not limited to gaming machines including only video display devices for conveying results. It is possible to implement a feature game within the scope of the present invention using an electro mechanical arrangement or even a purely mechanical arrangement for displaying the symbols or first and second animations or reactions needed to complete the wheel enhancement game as described herein. For example, a gaming machine suitable for providing a wheel bonus game may include a mechanical wheel display rather than a video-type display device for displaying results in the wheel game, and include a video display device for presenting the base game separately.

Still referring to the hardware and logical block diagram 200 showing an example design for a gaming machine 100, the depicted machine in operation is controlled generally by CPU 205 which stores operating programs and data in memory 207 with wagering game 204, user interface 220, network controller 210, audio/visual controllers, and reel assembly 213 (if mechanical reel configuration). CPU or game processor 205 may comprise a conventional microprocessor, such as an Intel Pentium microprocessor, mounted on a printed circuit board with supporting ports, drivers, memory, software, and firmware to communicate with and control gaming machine operations, such as through the execution of coding stored in memory 207 including one or more wagering games 204. Game processor 205 connects to user interface 220 such that a player may enter input information, and game processor 205 may respond according to its programming, such as to apply a wager and initiate execution of a game.

Figure 5:
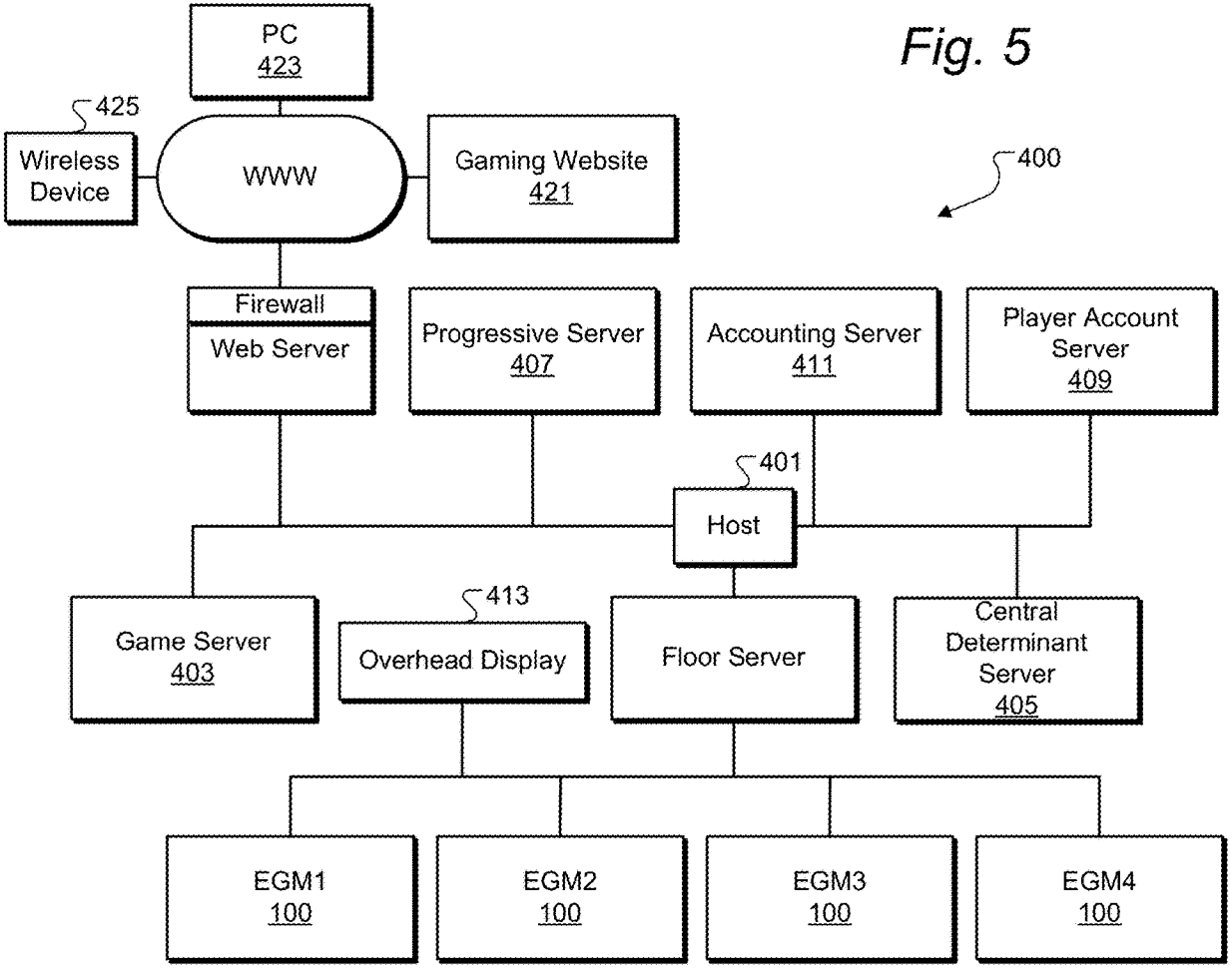
FIG. 5 is a system block diagram of a gaming system according to one embodiment of the present invention.

Game processor 205 also may connect through network controller 210 to a gaming network, such as example casino server network 400 shown in FIG. 5. Referring now to FIG. 5, the casino server network 400 may be implemented over one or more site locations and include host server 401, remote game play server 403 (which may be configured to provide game processor functionality including determining game outcomes and providing audio/visual instructions to a remote gaming device), central determinant server 405 (which may be configured to provide random numbers to gaming processes, or to determine lottery, bingo, or other centrally determined game outcomes and provide the information to networked gaming machines 100 providing lottery and bingo-based wagering games to patrons), progressive server 407 (which may be configured to accumulate a progressive pool from a portion of wagering proceeds or operator marketing funds and to award progressive awards upon the occurrence of a progressive award winning event to one or more networked gaming machines 100), player account server 409 (which may be configured to collect and store player information and/or awards and to provide player information to gaming machines 100 after receiving player identification information such as from a player card), and accounting server 411 (which may be configured to receive and store data from networked gaming machines 100 and to use the data to provide reports and analyses to an operator). Through its network connection, gaming machine 100 may be monitored by an operator through one or more servers such as to assure proper operation, and, data and information may be shared between gaming machine 100 and respective of the servers in the network such as to accumulate or provide player promotional value, to provide server-based games, or to pay server-based awards.

As depicted in FIG. 5, a block diagram of an example networked gaming system 400 may be associated with one or more gaming facilities, including one or more networked gaming machines 100 in accordance with various embodiments. With reference to FIG. 5, while a few servers have been shown separately, they may be combined or split into additional servers having additional capabilities.

As shown, networked gaming machines 100 (EGM1-EGM4) and one or more overhead displays 413 may be network connected and enable the content of one or more displays of gaming machines 100 to be mirrored or replayed on an overhead display. For example, the primary display content may be stored by the display controller or game processor 205 and transmitted through network controller 210 to the overhead display controller either substantially simultaneously or at a subsequent time according to either periodic programming executed by game processor 205 or a triggering event, such as a jackpot or large win, at a respective gaming machine 100. In the event that gaming machines 100 have cameras installed, the respective player's video images may be displayed on overhead display 413 along with the content of the player's gaming machine 100 and any associated audio feed.

In one or more embodiments, game server 403 may provide server-based games and/or game services to network connected gaming devices, such as gaming machines 100 (which may be connected by network cable or wirelessly). Progressive server 407 may accumulate progressive awards by receiving defined amounts (such as a percentage of the wagers from eligible gaming devices or by receiving funding from marketing or casino funds) and provide progressive awards to winning gaming devices upon a progressive event, such as a progressive jackpot game outcome or other triggering event such as a random or pseudo-random win determination at a networked gaming device or server (such as to provide a large potential award to players playing the community feature game). Progressive prizes may be made available to be won through display on the bonus game wheel's segments. Accounting server 411 may receive gaming data from each of the networked gaming devices, perform audit functions, and provide data for analysis programs, such as the IGT Mariposa program bundle.

Player account server 409 may maintain player account records, and store persistent player data such as accumulated player points and/or player preferences (e.g. game personalizing selections or options). For example, the player tracking display may be programmed to display a player menu that may include a choice of personalized gaming selections that may be applied to a gaming machine 100 being played by the player.

In one or more embodiments, the player menu may be programmed to display after a player inserts a player card into the card reader. When the card reader is inserted, an identification may be read from the card and transmitted to player account server 409. Player account server 409 transmits player information through network controller 210 to user interface 220 for display on the player tracking display. The player tracking display may provide a personalized welcome to the player, the player's current player points, and any additional personalized data. If the player has not previously made a selection, then this information may or may not be displayed. Once the player makes a personalizing selection, the information may be transmitted to game processor 205 for storing and use during the player's game play. Also, the player's selection may be transmitted to player account server 409 where it may be stored in association with the player's account for transmission to the player in future gaming sessions. The player may change selections at any time using the player tracking display (which may be touch sensitive or have player-selectable buttons associated with the various display selections).

In one or more embodiments, a gaming website may be accessible by players, e.g. gaming website 421, whereon one or more games may be displayed as described herein and played by a player such as through the use of personal computer 423 or handheld wireless device 425 (e.g. Apple iPhone, Android phone, tablet, phablet, virtual reality device, iPad, etc.). To enter the website, a player may log in with a username (that may be associated with the player's account information stored on player account server 409 or be accessible by a casino operator to obtain player data and provide promotional offers), play various games on the website, make various personalizing selections and save the information, so that during a next gaming session at a casino establishment, the player's playing data and personalized information may be associated with the player's account and accessible at the player's selected gaming machine 100.

Figure 6:
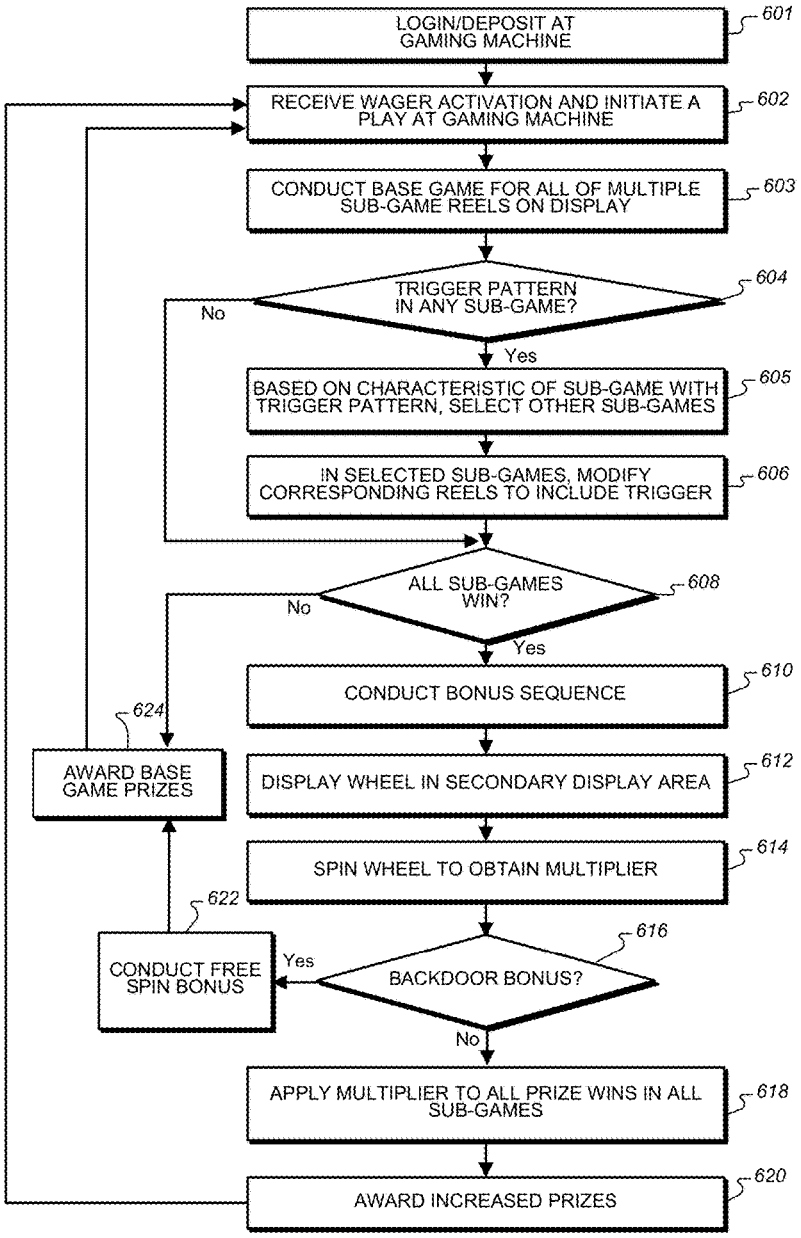
FIG. 6 is a screenshot of a an example game display according to an embodiment with in which gaming and bonus game graphics are shown on a primary display.

FIG. 6 is a flowchart showing a process for providing a wagering game according to one or more additional example embodiments of the invention. Generally, the process is conducted under control of one or more electronic processors to present gaming results on one or more displays on a gaming machine such as those described above. The process starts at block 601 where a player logs in or deposits money or a credit voucher at a gaming machine, such as by inserting currency or a voucher ticket into a currency/voucher reader of the gaming machine. To begin a game play, the method receives a wager activation on a player input device at the gaming machine at block 602, which typically consists of some input from the player to set the amount to be wagered from their credit amount on the machine. Preferably a single wager applies to all four of the game presentations and there is no ability to wager on a particular presentation separately. Other versions may split the wager among the sub-game presentations as discussed with regard to the embodiment of FIG. 2. The wager amount may also be carried over from previous game rounds by simply starting the game with the previous wager amount set. This typically happens through a 'Play' button (110, FIG. 3) on the game cabinet or touchscreen display, and serves to place the wager and start a single round of game play in the base game at block 603. In embodiments having reels, reel displays, or simulated reels, this is conducted by spinning the reels. Other embodiments may otherwise rearrange or randomize the symbols on the matrix in any suitable manner. For games that use other methods of scrambling the matrix besides simulated reels, the random outcome is determined at this step as appropriate for the game. The preferred version generates at least one random number and uses the at least one random number to determine a set of game reel stops, which is fed to a first data structure (230, FIG. 4) for providing the multiple game presentations. Separate reel stops are provided for each game presentation and specify a position in which multiple simulated or mechanical reels in of the game presentations will stop to display symbols in a symbol array in a spin outcome for the wager. Preferably the multiple game presentations are activated simultaneously, and have at least a period during their game presentation in which all the presentations show motion, reel spinning, or other randomization of the symbols simultaneously. The presentations may also stop to produce a result simultaneously.

In any event, block 603 conducts a base game round concluding with base game results in which the multiple matrices of symbol locations displayed on one of the gaming displays are populated with randomly selected symbols. Each of the matrices may be considered a separate game presentation and result, but they are referred to as sub-games because preferably the multiple outcomes are all based on the single wager and a single random outcome from a random number or a randomized pre-generated outcome provided by a random number generator or bank of outcomes on the gaming machine or on a central determinant server (405, FIG. 5). The base game results include a possibility of winning money value credits and a possibility of winning a bonus game outcome.

After the base game outcome is created at block 603, the process goes to block 604 where it evaluates each of the sub-games for the presence of a designated trigger pattern. In a preferred version, the trigger pattern is called 'Wild Match' and consists of a group of wild logo symbols landing together on any reel. Preferably the pattern requires a full reel, meaning all symbol locations on a reel must have the wild logo symbol to provide a trigger pattern. For example, in the diagram of FIG. 1, the depicted sub-games have four-symbol columns 52 representing simulated reels, and all four symbol locations 54 of a particular reel should have the wild symbol to provide the Wild Match trigger pattern. While this particular trigger pattern is described as an example, other suitable trigger patterns may be employed, particularly those that include multiple high-value symbols such as wilds or symbols that evaluate to relatively higher prizes within the particular game being played in each of the sub-games. A trigger pattern typically includes multiple symbol locations having a designated symbol or another type of winning pattern that has been designated as a trigger. Further, while a trigger pattern is described at block 604 and employed to alter the sub-games at blocks 605 and 606, in some versions a single trigger symbol may be used instead of a pattern.

If no trigger pattern is found at block 604, the process goes to block 608 and continues evaluating the base game outcome. If there is a trigger pattern found at block 604, the process goes to block 605 where it selects other sub-games besides the sub-game including the trigger pattern, the selection based on a characteristic of the sub-game which includes the trigger pattern. In this version, the characteristic used is the displayed order on the gaming machine display. For example, in FIG. 1, the gaming area of display 104 includes four separate presentations of different reel-type base games. The positions of the four symbol location matrices 51 may be given a number or order, such as the standard left-to-right and top-to-bottom order, and the position of the matrix on which a trigger pattern occurs may provide the number used for the characteristic. This characteristic, the sub-game number or matrix number, may then be used to select all the sub-games having a higher number than that having a trigger pattern, for example. Many other selection methods may be used, for example, position, sub-games having designated symbols or symbol combinations related to the triggered sub-game, or sub-games having lower prize results than the triggered sub-game, or higher prize results, may be selected. Other suitable characteristics may be used, such as the type of trigger pattern for embodiments in which more than one trigger pattern is employed, or the reel number on which the trigger pattern occurs within the sub-game.

Figure 8:
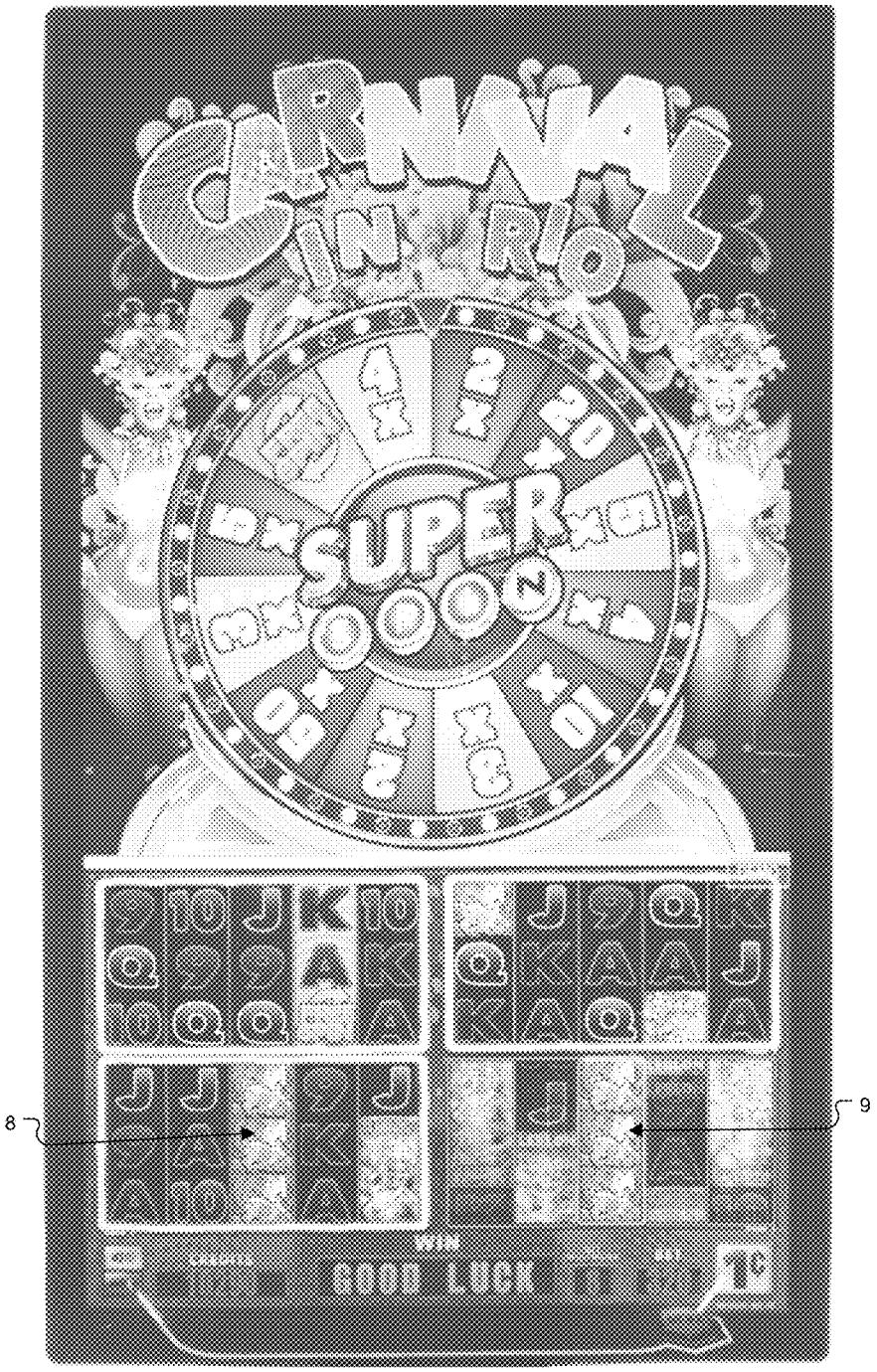

At block 606, the process modifies the game presentations of the selected sub-games. In this version, the modification includes modifying the reel of each selected sub-game that corresponds to the reel on which the trigger pattern was formed. For example, if the trigger pattern was formed on the first reel (column 52, FIG. 1) of the second matrix 51, and the characteristic used to select other sub-games was to select all sub-games appearing after (in order) the triggered game, then the third and fourth matrices on the display would be selected. In this example, the matrices' first reel would then be modified to contain the same trigger pattern. If the pattern is a full stack of wild symbols like the Wild Match feature of the preferred game described herein, the full stack of wilds is reproduced in each of the selected reels. The screenshot of FIG. 8 shows an example of a trigger pattern, in this case each sub-game includes a three by five matrix, and a stacked group of three wild symbols 8 has appeared on the lower left sub-game presentation (the third sub-game). In response, the process displays a graphic sequence showing the stacked wild group 8 being duplicated and moving to appear at 9 on the fourth sub-game on the lower right. In this version, as shown by the blurred symbols, the graphic sequence occurs after the third sub-game reels have stopped spinning but the fourth sub-game reels are still spinning, as depicted by the blurred symbols on the reels. Such a modification increases the chance of winning a prize, increases the expected prize amount, and increases the probability of triggering other features such as the bonus game which may be triggered at block 608. The blocks after block 606, which are blocks 608-624, proceed similarly to the process of FIG. 2, which will not be described again here.

The process functionality is controlled by the system processor by executing program code, executable by a gaming machine or gaming network processor, to accomplish the functionality as described herein.

Referring generally to the description herein, any use of ordinal terms such as "first," "second," "third," etc., to refer to an element does not by itself connote any priority, precedence, or order of one element over another, or the temporal order in which acts of a method are performed. Rather, unless specifically stated otherwise, such ordinal terms are used merely as labels to distinguish one element having a certain name from another element having a same name (but for use of the ordinal term).

Further, as described herein, the various features have been provided in the context of various described embodiments, but may be used in other embodiments. The combinations of features described herein should not be interpreted to be limiting, and the features herein may be used in any working combination or sub-combination according to the invention. This description should therefore be interpreted as providing written support, under U.S. patent law and any relevant foreign patent laws, for any working combination or some sub-combination of the features herein.

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A gaming machine comprising:

a cabinet to which is mounted one or more video displays;

a controller operatively coupled to control the one or more video displays;

a credit input device in communication with the controller and adapted for accepting a physical item associated with a monetary value that establishes a player credit balance;

a plurality of player-activated input devices in communication with the controller for setting wagers covered by the credit balance and initiating games for determining the outcomes of the wagers;

a first data structure stored in a memory comprising data corresponding to four or more game presentations, each including a set of virtual reel strips including game symbols;

a second data structure stored in the memory comprising data corresponding to a bonus game structure;

wherein the controller is programmed to:

cause the four or more game presentations to be displayed simultaneously by at least one of the displays;

in response to a wager activation by a player on one of the player-activated input devices, cause the four or more game presentations to all simultaneously display conducting a game including spinning their respective sets of virtual reels and stopping to produce a respective randomly selected outcome, and evaluate the outcomes for winning patterns each having an associated credit award;

determine if the four or more virtual game presentations all include a winning pattern, and if so, activate the bonus game structure to display the conduct of a bonus game and a bonus game result;

based on the bonus game result, applying a base game modifier or awarding a bonus prize amount in addition to a base game prize and crediting the resulting amount to the credit balance; and receive a player cash out input through a player control and, in response, initiate a payout of the credit balance.

2. The gaming machine of claim 1, in which the second data structure includes a wheel including a plurality of sections containing different multiplier values, the wheel adapted to be spun when activated and stop on a section to select the multiplier value of that section.

3. The gaming machine of claim 2, in which the wheel includes a section operable to activate a free spin bonus when the wheel stops on that section.

4. The gaming machine of claim 1, in which the four or more game presentations includes four presentations each having a five-reel game, and in which the winning patterns are formed by designated paylines in each of the four five-reel games.

5. The gaming machine of claim 1, in which based on the bonus result, a base game prize modifier is applied by applying a multiplier based on the bonus result to all of the credit awards of the four or more game presentations.

6. A method of providing a wagering game under control of a gaming machine electronic controller, the method comprising:

receiving a player deposit through a credit input device and in response activating a credit meter value that establishes a player credit balance;

activating a first data game presentation data structure causing four or more game presentations to be displayed simultaneously by at least one display on a gaming machine;

in response to a wager activation by a player on a player input device, causing the four or more game presentations to all simultaneously display conducting a game including spinning their respective sets of virtual reels and stopping to produce a respective randomly selected outcome, and evaluating the outcomes for winning patterns each having an associated credit award;

determining if the four or more game presentations all include a winning pattern, and if so, activating a bonus game data structure to display the conduct of a bonus game and a bonus game result;

based on the bonus game result, applying a base game modifier or awarding a bonus prize amount in addition to a base game prize and crediting the resulting amount to the credit balance; and receiving a player cash out input through a player control and, in response, initiating a payout of the credit balance.

7. The method of claim 6, in which the bonus game data structure includes a wheel including a plurality of sections containing different multiplier values, the wheel is spun when activated and stops on a section to select the multiplier value of that section.

8. The method of claim 7, in which the wheel includes a section operable to activate a free spin bonus when the wheel stops on that section.

9. The method of claim 6, in which the four or more game presentations includes four presentations each having a five-reel game, and in which the winning patterns are formed by designated paylines in each of the four five-reel games.

10. The method of claim 6, in which based on the bonus result, a base game prize modifier is applied by applying a multiplier based on the bonus result to all of the credit awards of the four or more game presentations.

11. The method of claim 6, further comprising:

before determining if the game presentations all have a winning pattern, detecting the presence of a trigger pattern in one of the game presentations;

in response, based on a characteristic of the game presentation including the trigger pattern, selecting one or more of the other game presentations; and in the selected one or more game presentations, modifying a corresponding virtual reel strip to include the trigger pattern.

12. A gaming machine comprising:

a cabinet to which is mounted one or more video displays;

a controller operatively coupled to control the one or more video displays;

a credit input device in communication with the controller and adapted for accepting a physical item associated with a monetary value that establishes a player credit balance;

a plurality of player-activated input devices in communication with the controller for setting wagers covered by the credit balance and initiating games for determining the outcomes of the wagers;

a first data structure stored in a memory comprising data corresponding to four or more game presentations, each including a set of virtual reel strips including game symbols;

a second data structure stored in the memory comprising data corresponding to a bonus game structure;

wherein the controller is programmed to:

cause the four or more game presentations to be displayed simultaneously by at least one of the displays;

in response to a wager activation by a player on one of the player-activated input devices, cause the four or more game presentations to all simultaneously display conducting a game including spinning their respective sets of virtual reels and stopping to produce a respective randomly selected outcome, and evaluate the outcomes for winning patterns each having an associated credit award;

detect the presence of a trigger pattern in one of the game presentations;

in response, based on a characteristic of the game presentation including the trigger pattern, select one or more of the other game presentations;

in the selected one or more game presentations, modifying a corresponding virtual reel strip to include the trigger pattern; and then, evaluating the game presentations for winning patterns.

13. The gaming machine of claim 12, wherein the controller is further programmed to:

after evaluating the game presentations for winning patterns, determine if the four or more game presentations all include a winning pattern, and if so, activate the bonus game structure to display the conduct of a bonus game and a bonus game result;

based on the bonus game result, applying a base game modifier or awarding a bonus prize amount in addition to a base game prize and crediting the resulting amount to the credit balance; and receive a player cash out input through a player control and, in response, initiate a payout of the credit balance.

* * * * *